US011510465B2

(12) United States Patent
Tang et al.

(10) Patent No.: US 11,510,465 B2
(45) Date of Patent: Nov. 29, 2022

(54) ULTRA-THIN FOLDING LUGGAGE CASE

(71) Applicant: Changfu Tang, Dongguan (CN)

(72) Inventors: Changjin Tang, Dongguan (CN); Changfu Tang, Dongguan (CN)

(73) Assignee: Changfu Tang, Guangdong (CN)

( * ) Notice: Subject to any disclaimer, the term of this patent is extended or adjusted under 35 U.S.C. 154(b) by 448 days.

(21) Appl. No.: 16/600,469

(22) Filed: Oct. 12, 2019

(65) Prior Publication Data

US 2020/0037715 A1 Feb. 6, 2020

Related U.S. Application Data

(63) Continuation of application No. PCT/CN2018/085762, filed on May 6, 2018.

(30) Foreign Application Priority Data

Dec. 12, 2017 (CN) ..... 201721723345.5

(51) Int. Cl.
*A45C 5/14* (2006.01)
*A45C 7/00* (2006.01)

(52) U.S. Cl.
CPC ..... *A45C 7/0036* (2013.01); *A45C 5/14* (2013.01)

(58) Field of Classification Search
CPC ..... A45C 5/14; A45C 7/0036; A45C 7/0054; A45C 7/0077
USPC ..... 190/18 A, 107; 220/6, 7; 70/69
See application file for complete search history.

(56) References Cited

U.S. PATENT DOCUMENTS

| | | | | |
|---|---|---|---|---|
| 10,383,414 | B2 | 8/2019 | Tan | |
| 2007/0012695 | A1* | 1/2007 | Yang | B60R 7/02 220/8 |
| 2010/0282555 | A1* | 11/2010 | Tseng | A45C 7/0036 190/103 |
| 2012/0055750 | A1 | 3/2012 | Xiao | |
| 2013/0014550 | A1* | 1/2013 | Xie | E05B 65/52 70/69 |
| 2014/0311848 | A1 | 10/2014 | Meersschaert et al. | |

(Continued)

FOREIGN PATENT DOCUMENTS

| | | | |
|---|---|---|---|
| CN | 202385986 | U | 8/2012 |
| CN | 206238653 | U | 6/2017 |

(Continued)

OTHER PUBLICATIONS

Internation Search Report of PCT/CN2018/085762, dated Aug. 8, 2018.

*Primary Examiner* — Sue A Weaver

(57) ABSTRACT

The utility model, discloses an ultra-thin folding luggage case, comprising an upper panel. A right side panel is arranged on a right side of a left side panel, and a lower panel is arranged on the bottom of the right side panel. A side lifting handle is fixedly connected with a side surface of the left side panel, and placing foot pads are fixedly connected with a side surface of the right side panel. A flip cover plate is arranged on a side surface of the lower panel, and a return spring is arranged inside the flip cover plate. A pull rod storage groove is fixedly connected with the bottom of the lower panel, and a pull rod is arranged inside the pull rod storage groove. Universal wheels are arranged on the bottom of the lower panel and the bottom of a connecting frame.

5 Claims, 6 Drawing Sheets

(56) References Cited

U.S. PATENT DOCUMENTS

| | | | | |
|---|---|---|---|---|
| 2015/0114776 | A1* | 4/2015 | Mathieu | A45C 7/0054<br>190/127 |
| 2015/0327640 | A1* | 11/2015 | Armani | A45C 5/146<br>190/18 A |

FOREIGN PATENT DOCUMENTS

| | | | |
|---|---|---|---|
| DE | 202008003407 | U1 | 9/2008 |
| JP | 2002159236 | A | 6/2002 |

* cited by examiner

ULTRA-THIN FOLDING LUGGAGE CASE

CROSS-REFERENCE TO RELATED APPLICATIONS

This application is a continuation of International Patent Application No. PCT/CN2018/085762, filed May 6, 2018, which claims priority to Chinese Patent Application No. 201721723345.5, filed on Dec. 12, 2017. The disclosures of the aforementioned applications are hereby incorporated by reference in their entireties.

TECHNICAL FIELD

The utility model relates to the technical field of folding cases, and particularly relates to an ultra-thin folding luggage case.

BACKGROUND OF THE PRESENT INVENTION

A luggage case, is an important tool to be used during travels. When the luggage case is used, the luggage case can move through wheels on the bottom and a pull, rod, which is convenient to use and achieves a large storage space.

However, the existing luggage case has too large volume, is inconvenient to store when not in use, and is not folding, causing inconvenience in use.

SUMMARY OF PRESENT INVENTION

The purpose of the utility model is to provide an ultra-thin folding luggage case to solve the problems proposed in the above background that the existing luggage case has too large volume, is inconvenient to store when not in use, and is not folding, causing inconvenience in use.

To achieve the above purpose, the utility model provides the following technical solution: an ultra-thin folding luggage case comprises an upper panel, wherein the bottom of the upper panel is fixedly connected with a connecting frame, and a side surface of the connecting frame is fixedly connected with an outer connecting shaft; an outer side of the outer connecting shaft is provided with an inner connecting shaft, and the bottom of the inner connecting shaft is fixedly connected with a left side panel; a right side panel is arranged on a right side of the left side panel, and a lower panel is arranged on the bottom of the right side panel; a side lifting handle is fixedly connected with a side surface of the left side panel, and placing foot pads are fixedly connected with a side surface of the right side panel; a flip cover plate is, arranged on a side surface of the lower panel, and a return spring is arranged inside the flip cover plate; the top of the flip cover plate is fixedly connected with a top lifting handle; a pull rod storage groove is fixedly connected with the bottom of the lower panel, and a pull rod is arranged inside the pull rod storage groove; universal wheels are arranged on the bottom of the lower panel and the bottom of a connecting frame; a coded lock disc is fixedly connected with the top of the upper panel; the top of the flip cover plate is provided with a fixing catching groove, and a fixing buckle is arranged on the inner side of the fixing catching groove; a lower surface of the upper panel is provided with six clamping blocks; six grooves are formed on four corners of the upper surface of the connecting frame; and the sizes of grooves are matched with the sizes of the clamping, blocks.

Preferably, the upper panel and the left side panel are respectively arranged in parallel to the lower panel and the right side panel; and a rotating movable connecting structure is formed among the upper panel, the left side panel, the lower panel and the right side panel through the inner connecting shaft and the outer connecting shaft.

Preferably, the lower panel forms a buckling movable connecting structure with the upper panel through the fixing catching groove, and the fixing buckle.

Preferably, the flip cover plate forms a return rotating movable connecting structure with the lower panel through the return spring.

Preferably, the connecting frame has a thickness of 3-6 cm, and the shape of the inner side of the connecting frame is matched with the shape of the upper panel.

Compared with the prior art, the utility, model has the following beneficial effects: the folding luggage case can fold the upper panel, the left side panel, the lower panel and the right side panel through the, inner connecting shaft and the outer connecting shaft, so as to fold the folding luggage case, thereby occupying less space during storage. The upper panel and the left side panel of the folding luggage case are respectively arranged in parallel to the lower panel and the right side panel; and a rotating movable connecting structure is formed among the upper panel, the left side panel, the lower panel and the right side panel through the inner connecting shaft and the outer connecting shaft. In this way, the folding luggage case can fold the upper panel, the left side panel, the lower panel and the right side panel so that the folding luggage case is more convenient in storage. The lower panel of the folding luggage case forms a buckling movable connecting structure with the upper panel through the, fixing catching groove and the fixing buckle. In this way, the luggage case which is, folded can be fixed through the fixing catching groove and the fixing buckle, which prevents the luggage case from bouncing and making the use more convenient. The flip cover plate of the folding luggage case forms a return rotating movable connecting structure with the lower panel through the return spring. In this way, the, flip cover plate can automatically bounce through the return spring, which is more convenient and easier for assembly. The connecting frame of the folding luggage case has a thickness of 3-6 cm, and the shape of the inner side of the connecting frame is matched with the shape of the upper panel. Thus, the structure of the folding luggage case is firmer, and the connecting frame makes the folding luggage case more resistant to pressure.

In the figures: 1 upper panel; 2 lower panel; 3 left side panel; 4 side lifting handle; 5 universal wheel; 6 coded lock disc; 7 fixing catching groove; 8 fixing buckle; 9 return spring; 10 inner connecting shaft; 11 placing foot pad; 12 flip cover plate; 13 top lifting handle; 14 outer connecting shaft;

15 connecting frame; 16 pull rod; 17 pull rod storage groove; 18 right side panel; 19 groove; and 20 clamping block.

DETAILED DESCRIPTION OF PREFERRED EMBODIMENTS

The technical solutions in the embodiments of the utility model will be clearly and fully described below in combination with the drawings in the embodiments of the utility model. Apparently, the described embodiments are merely part of the embodiments of the utility model, not all of the embodiments. Based on the embodiments in the utility model, all other embodiments obtained by those ordinary skilled in the art without contributing creative labor will belong to the protection scope of the utility model.

Figure 1:
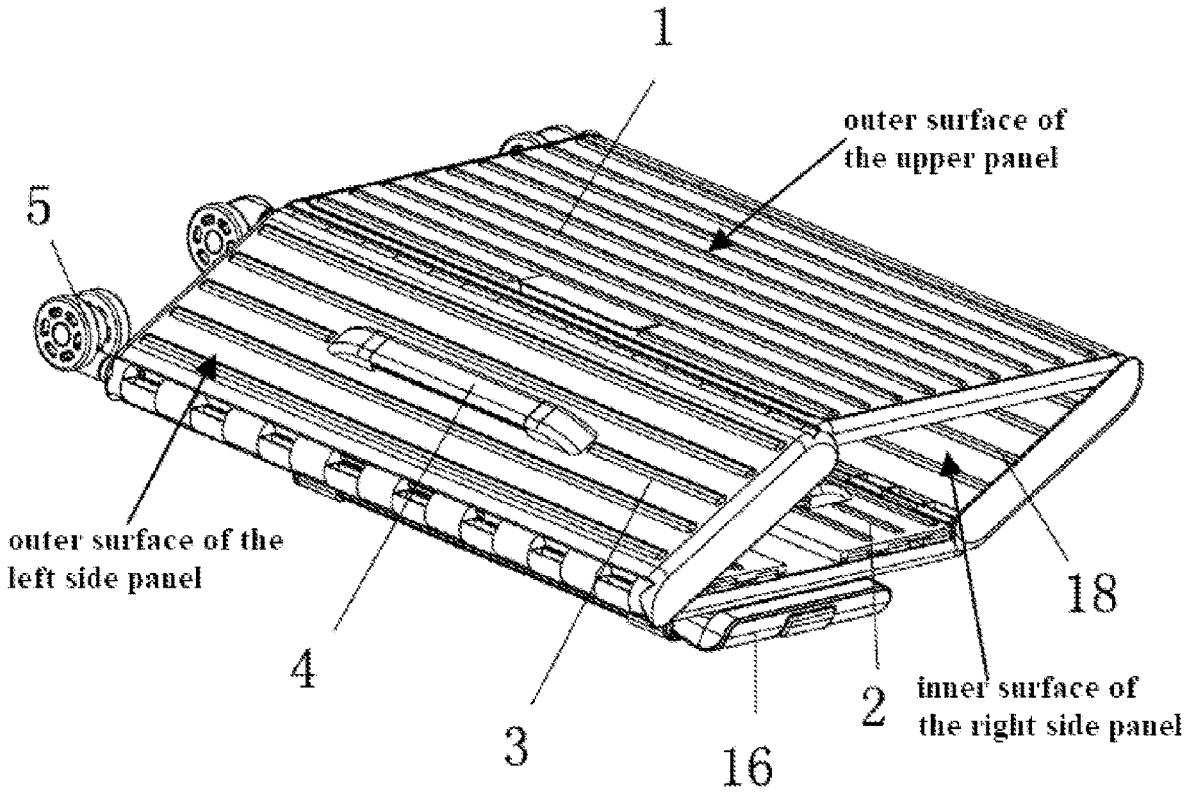
FIG. 1 is a three-dimensional structural schematic diagram of the utility model.
Figure 2:
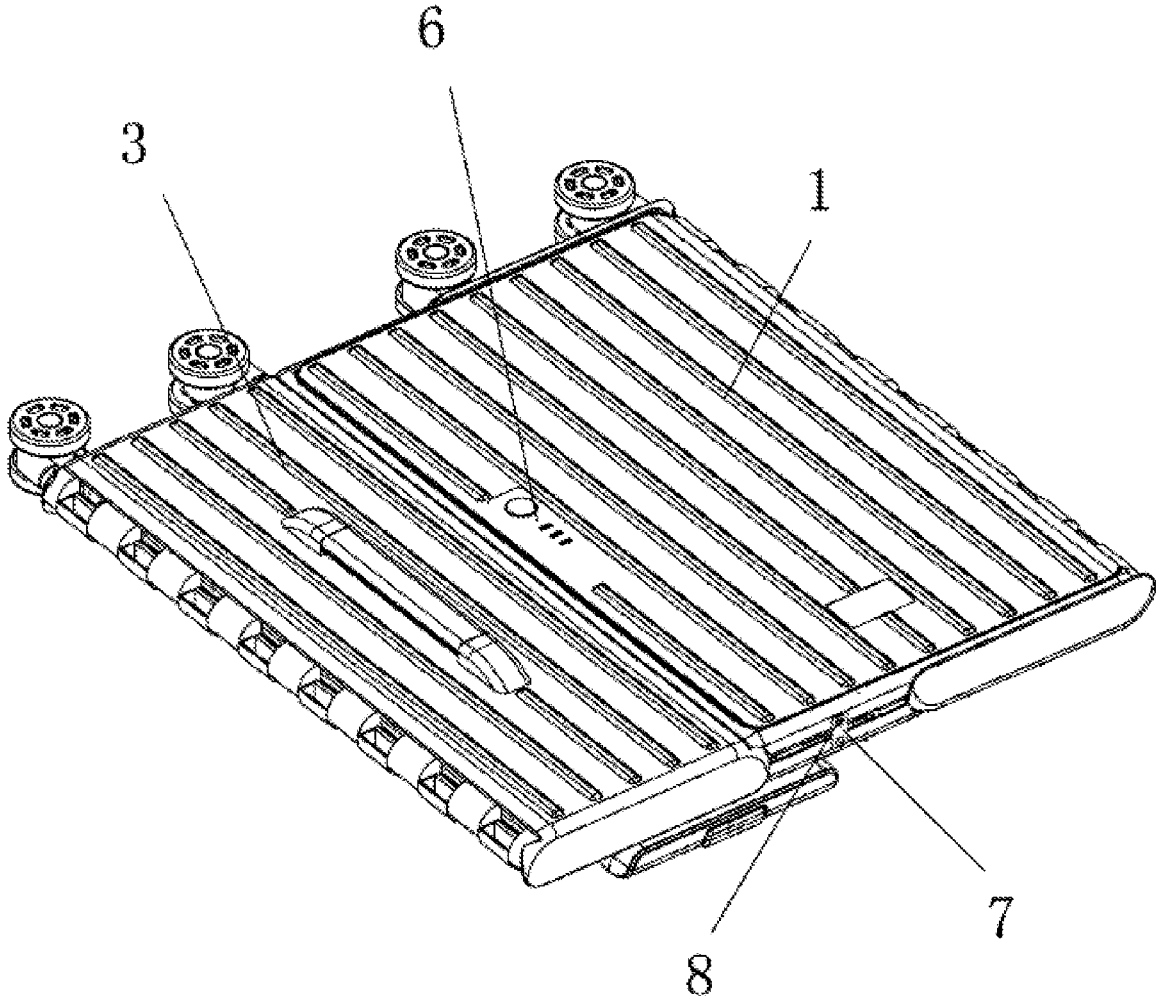
FIG. 2 is a structural schematic diagram after folding of the utility model.
Figure 3:
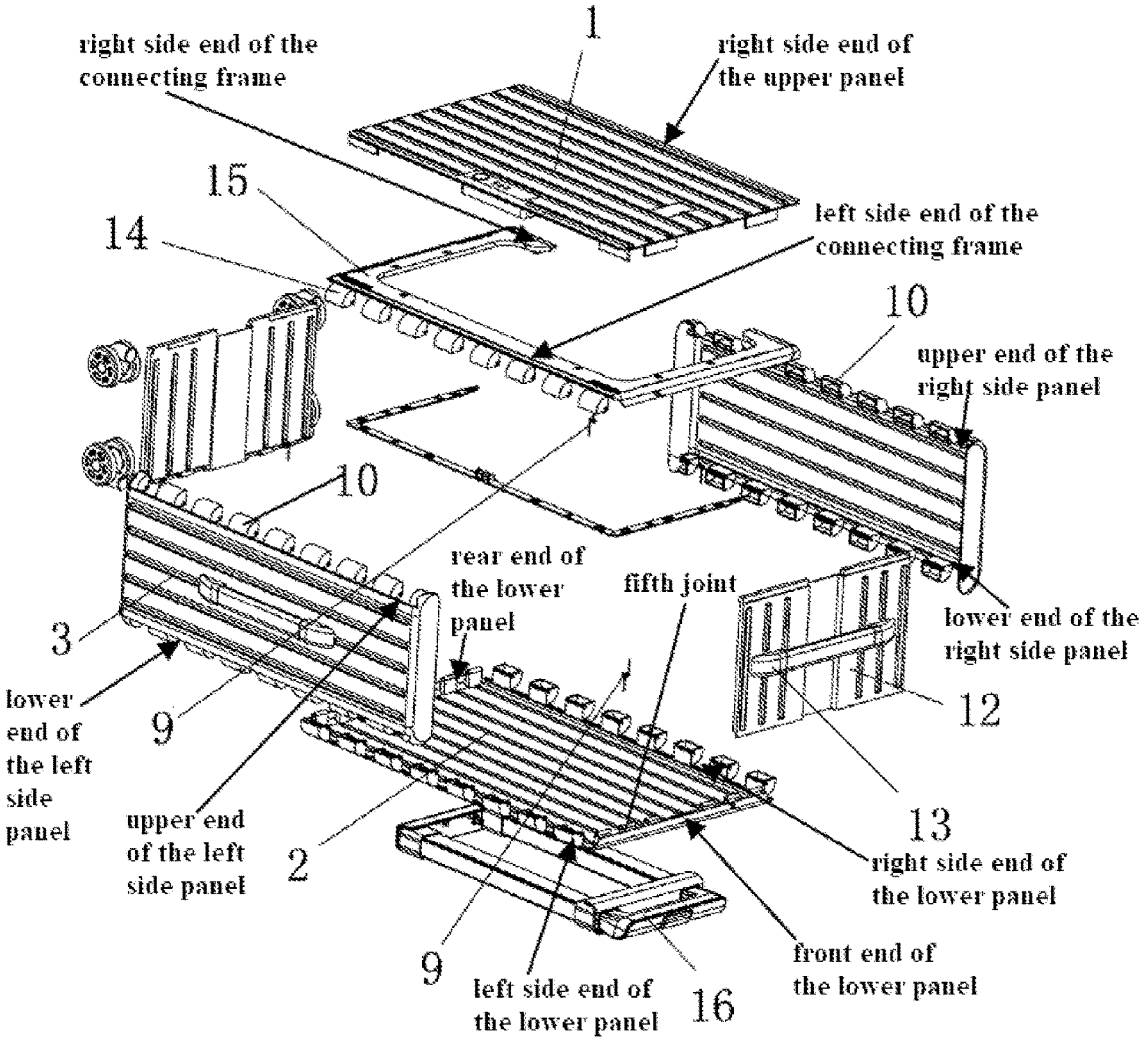
FIG. 3 is an exploded structural schematic diagram of the utility model.
Figure 4:
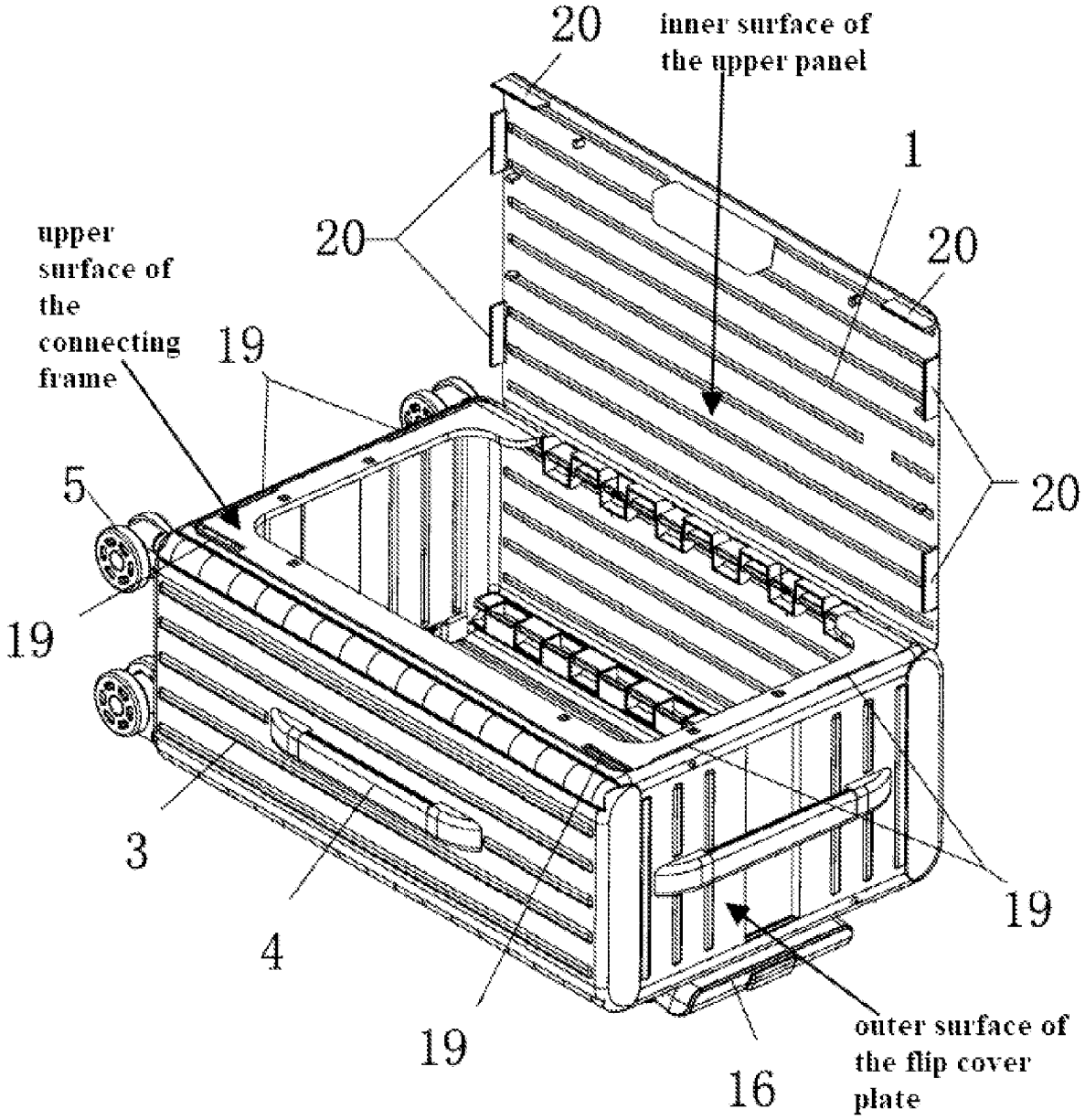
FIG. 4 is a structural schematic diagram of an entire opened state of the utility model.
Figure 5:
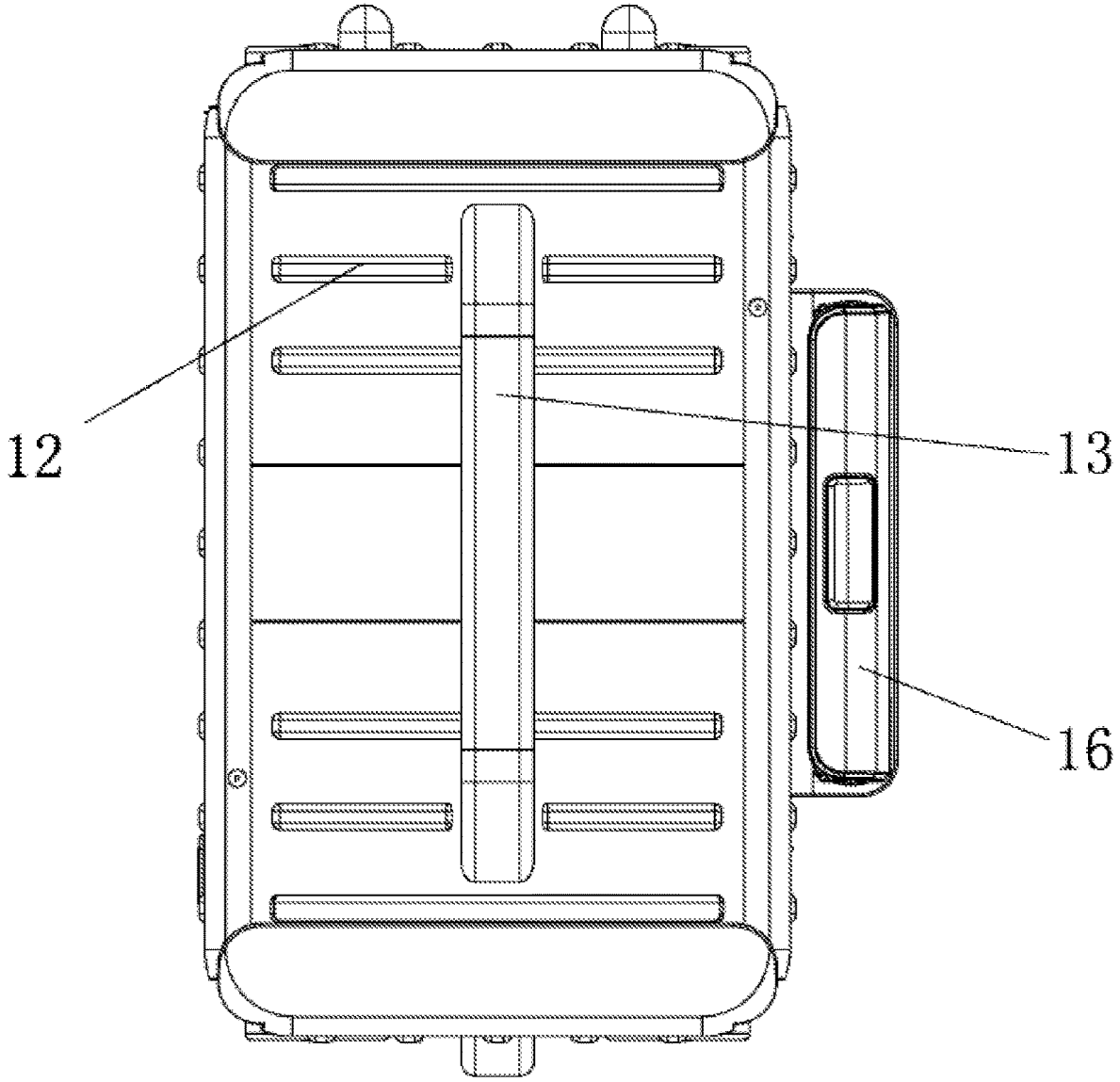
FIG. 5 is a top structural schematic diagram of the utility model.
Figure 6:
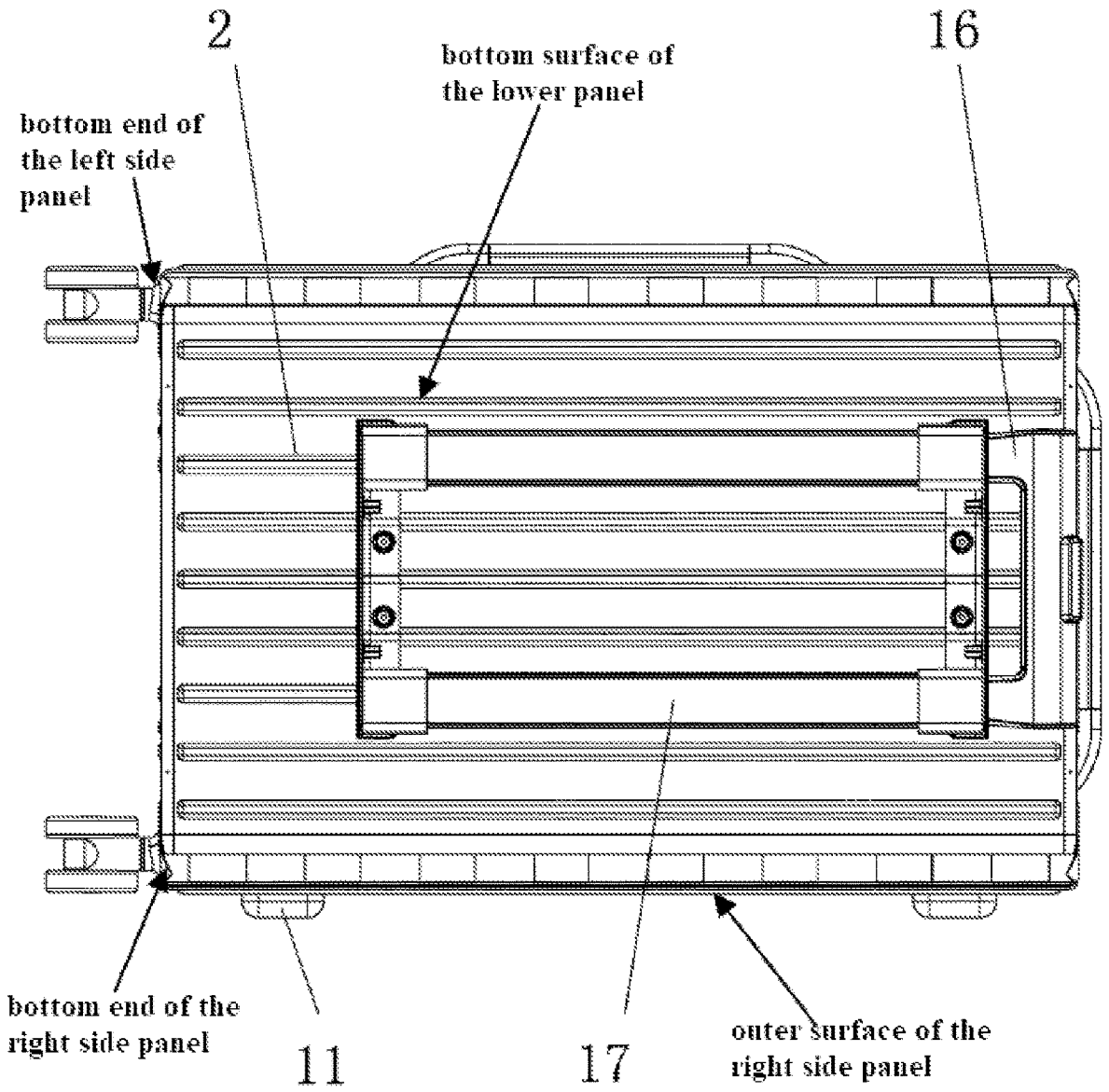
FIG. 6 is a rear structural schematic diagram of the utility model.

By referring to FIG. 1 to FIG. 6, the utility model provides a technical solution: an ultra-thin folding luggage case comprises an upper panel 1, wherein the bottom of the upper panel 1 is fixedly connected with a connecting frame 15, and a side surface of the connecting frame 15 is fixedly connected with an outer connecting shaft 14; the upper panel 1 and the left side panel 3 are respectively arranged in parallel to the lower panel 2 and the right side panel 18; a rotating movable connecting structure is formed among the upper panel 1, the left side panel 3, the lower panel 2 and the right side panel 18 through the inner connecting shaft 10 and the outer connecting shaft 14; and the connecting frame 15 has a thickness of 3-6 cm, and the shape of the inner side of the connecting frame 15 is matched with the shape, of the upper panel 1. In this way, the folding luggage case can fold the upper panel 1, the left side panel 3, the lower panel-2 and the right side panel 18, so that the folding luggage case is more convenient in storage. Thus, the structure of the folding luggage case is firmer, and the connecting frame 15 makes the folding luggage case more resistant to pressure. An outer side of the outer connecting shaft 14 is provided with an inner connecting shaft 10, and the bottom of the inner connecting shaft 10 is fixedly connected with a left side panel 3; a right side panel 18 is arranged on a right side of the left side panel 3, and a lower panel 2 is arranged on the bottom of the right side panel 18; and the lower panel 2 forms a buckling movable connecting structure with the upper panel 1 through the fixing catching groove 7 and the fixing buckle 8. In this way, the luggage case which is folded can be fixed through the fixing catching groove 7 and the fixing buckle 8, which prevents the luggage case from bouncing and making the use more convenient. A side lifting handle 4 is fixedly connected with a side surface of the left side panel 3, and placing foot pads 11 are fixedly connected with a side surface of the right side panel 18; a flip cover plate 12 is arranged on a side surface of the lower panel 2, and a return spring 9 is arranged inside the flip cover plate 12: the flip cover plate 12 forms a return rotating movable connecting structure with the lower panel 2 through the return spring 9. In this way, the flip cover plate 12 can automatically bounce through the return spring 9, which is more convenient and easier for assembly. The top of the flip cover plate 12 is fixedly connected with a top lifting handle 13; a pull rod storage groove 17 is fixedly connected with the bottom of the lower panel 2, and a pull rod 16 is arranged inside the pull rod storage groove 17; universal wheels 5 are arranged on the bottom of the lower panel 2 and the bottom of the connecting frame 15; a coded lock disc 6 is fixedly connected with the top of the upper panel 1; the top of the flip cover plate 12 is provided with a fixing catching groove 7, and a fixing buckle 8 is arranged on the inner side of the fixing catching groove 7; a lower surface of the upper panel 1 is provided with six clamping blocks 20; six grooves 19 are formed on four corners of the upper surface of the connecting frame 15; and the sizes of grooves 19 are matched with the sizes of the clamping blocks 20.

The working principle is as follows: firstly, the ultra-thin folding luggage case is inspected, and is used after confirming that the folding luggage case is normal. When the folding luggage case is used, firstly, the coded lock disc 6 is correspondingly opened in a mechanical password unlocking mode so that the connection between the upper panel 1 and the, connecting frame 15 is opened. Next, the upper panel 1 is turned and the clamping blocks 20 are separated from the grooves 19. Then, the buckling state of the fixing buckle 8 and the fixing catching groove 7 is released. Next, the left side panel 3, the lower panel 2 and the right side panel 18 are lifted by the cooperation between the inner connecting shaft 10 and the outer connecting shaft 14 until the left side panel 3, the lower panel 2 and the right side panel 18 are in a vertical state. At this moment, the flip cover plate 12 bounces under the action of the return spring 9, so that the flip cover plate 12 is attached to the edges of the left side panel 3 and the right side panel 18, and supports the upper panel 1, the left side panel 3, the lower panel 2 and the right side panel 18 to form a space. Next, stored articles can be put into the space. When the folding luggage case is not used, the flip cover plate 12 can be contracted into the folding luggage case. Then, the upper panel 1, the left side panel 3, the lower panel 2 and the right side panel 18 are pressed down by the cooperation between the inner connecting shaft 10 and the outer connecting shaft 14, so that the folding luggage case is contracted and becomes flat. Next, the fixing catching groove 7 and the fixing buckle 8 are buckled and fixed, which is easy for storage. The above is the use process of the folding luggage case.

Although the utility model is described in detail by referring to the above embodiments, those skilled in the art shall understand that the technical solution recorded in each of the above embodiments can be still amended, or some technical features therein can be replaced equivalently. Any modification, equivalent replacement, improvement, etc. made within the spirit and the principle of the utility model shall be included within the protection scope of the utility model.

We claim:

1. An ultra-thin folding luggage case, comprising:

an upper panel (1), a lower panel (2), a left side panel (3), a right side panel (18), a flip cover plate (12), a bottom plate (21), a pull rod storage groove (17), a pull rod (16), and wheels (5);

the upper panel (1) is fixedly connected with a connecting frame (15);

a left side end of the connecting frame (15) is movably connected to an upper end of the left side panel (3), so that the connecting frame (15) is rotatable between the connecting frame (15) and the left side panel (3);

a right side end of the upper panel (1) is movably connected to a right side end of the connecting frame (15) and an upper end of the right side panel (18), so that the upper panel (1) and the connecting frame (15) are rotatable between the upper panel (1) and the right side panel (18);

a left side end of the lower panel (2) is movably connected to a lower end of the left side panel (3), so that the left side panel (3) is rotatable between the left side panel (3) and the lower panel (2);

a right side end of the lower panel (2) is movably connected with a lower end of the right side panel (18), so that the right side panel (18) is rotatable between the right side panel (18) and the lower panel (2);

the left side panel (3) and the right side panel (18) are located at opposite sides of the lower panel (2);

a front end of the lower panel (2) is movably connected to the flip cover plate (12), so that the flip cover plate is rotatable towards an inner cavity formed by the upper panel, the lower panel, the left side panel, and the right side panel;

a rear end of the lower panel (2) is movably connected to the bottom plate (21), so that the bottom plate is rotatable towards the inner cavity;

the pull rod storage groove (17) is fixedly connected to a bottom surface of the lower panel (2), and the pull rod (16) is retractably connected to the pull rod storage groove (17); and the wheels (5) are arranged on the lower panel and the connecting frame;

wherein an outer surface of the flip cover plate (12) is fixedly provided with a top lifting handle (13);

at least two foot pads (11) are fixedly connected to an outer surface of the right side panel (18);

a coded lock disc (6) is fixedly located on an outer surface of the upper panel (1);

an inner surface of the upper panel (1) is provided with six clamping blocks (20);

six grooves (19) are formed on four corners of an upper surface of the connecting frame (15) adapted for the six clamping blocks, so that the upper panel is capable of connecting to the connecting frame (15).

2. The ultra-thin folding luggage case according to claim 1, wherein the upper panel (1) is arranged in parallel to the lower panel (2); the left side panel (3) is arranged in parallel to the right side panel (18).

3. The ultra-thin folding luggage case according to claim 1, the lower panel (2) is attachable to the upper panel (1), when the ultra-thin folding luggage case is folded, via a fixing buckle (8) and a fixing catching groove (7) formed on a top end of the flip cover plate.

4. The ultra-thin folding luggage case according to claim 1, wherein a return spring (9) is arranged between the flip cover plate (12) and the lower panel (2).

5. The ultra-thin folding luggage case according to claim 1, wherein the connecting frame (15) has a thickness of 3-6 cm, and the connecting frame (15) forms a recess adapted for the upper panel (1).

* * * * *